US011408243B2

(12) United States Patent
Schultz et al.

(10) Patent No.: US 11,408,243 B2
(45) Date of Patent: Aug. 9, 2022

(54) CEMENT PLUG FRAGMENTATION ENHANCEMENT

(71) Applicants: Alexander Schultz, Montgomery, TX (US); Dennis Jiral, Houston, TX (US)

(72) Inventors: Alexander Schultz, Montgomery, TX (US); Dennis Jiral, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 2 days.

(21) Appl. No.: 17/069,430

(22) Filed: Oct. 13, 2020

(65) Prior Publication Data

US 2022/0112784 A1 Apr. 14, 2022

(51) Int. Cl.
*E21B 33/12* (2006.01)
*E21B 33/124* (2006.01)
*E21B 33/16* (2006.01)

(52) U.S. Cl.
CPC ..... *E21B 33/1204* (2013.01); *E21B 33/124* (2013.01); *E21B 33/16* (2013.01)

(58) Field of Classification Search
CPC ..... E21B 33/16; E21B 33/165; E21B 33/167
See application file for complete search history.

(56) References Cited

U.S. PATENT DOCUMENTS

| | | | | |
|---|---|---|---|---|
| 4,190,112 | A | 2/1980 | Davis | |
| 4,979,562 | A * | 12/1990 | Langer | E21B 17/14 166/156 |
| 5,842,517 | A | 12/1998 | Coone | |
| 6,056,053 | A * | 5/2000 | Giroux | E21B 21/10 166/155 |
| 2014/0224505 | A1 | 8/2014 | Ramon | |
| 2017/0314365 | A1* | 11/2017 | Ojong | E21B 33/134 |
| 2020/0173252 | A1* | 6/2020 | Lende | E21B 33/16 |
| 2021/0123318 | A1* | 4/2021 | Agour | E21B 33/167 |

FOREIGN PATENT DOCUMENTS

| | | |
|---|---|---|
| EP | 1012442 B1 | 12/2005 |
| WO | 9004699 A2 | 5/1990 |

OTHER PUBLICATIONS

International Search Report and Written Opinion for International Application No. PCT/US2021/071802; International Filing Date Oct. 8, 2021; dated Jan. 21, 2022; 11 Pages.

* cited by examiner

*Primary Examiner* — David Carroll
(74) *Attorney, Agent, or Firm* — Cantor Colburn LLP

(57) ABSTRACT

A liner plug assembly includes liner plug for use in a casing. The liner plug includes a body for plugging the casing and a body fragmentation feature in the body for catching a cutter of a drill bit used to cut the body. The liner plug assembly includes the lead plug.

12 Claims, 6 Drawing Sheets

CEMENT PLUG FRAGMENTATION ENHANCEMENT

BACKGROUND

In the resource recovery industry, a casing can be deployed within a drilled wellbore in order to provide a conduit through which formation fluid can be recovered to the surface. The casing can be cemented into place in the wellbore by filling an annulus between the casing and a wall of the wellbore with a cement slurry. A plug, such as a Liner Wiper plug, is deployed within the casing to perform the cementing. Once the casing is cemented into place, the plug is generally milled out of the casing by a milling device or drill bit at an end of a drill string. Difficulties in milling out the plug affects how soon subsequent steps of the resource recovery operation can occur. Accordingly, there is a need to be able to ensure quick and efficient milling of the plug.

SUMMARY

Disclosed herein is a liner plug for use in a casing. The liner plug includes a body for plugging the casing and a body fragmentation feature in the body for catching a cutter of a drill bit used to cut the body.

Also disclosed herein is a liner plug assembly. The liner plug assembly includes a lead plug having a body for plugging the casing and a body fragmentation feature in the body for catching a cutter of a drill bit used to cut the body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
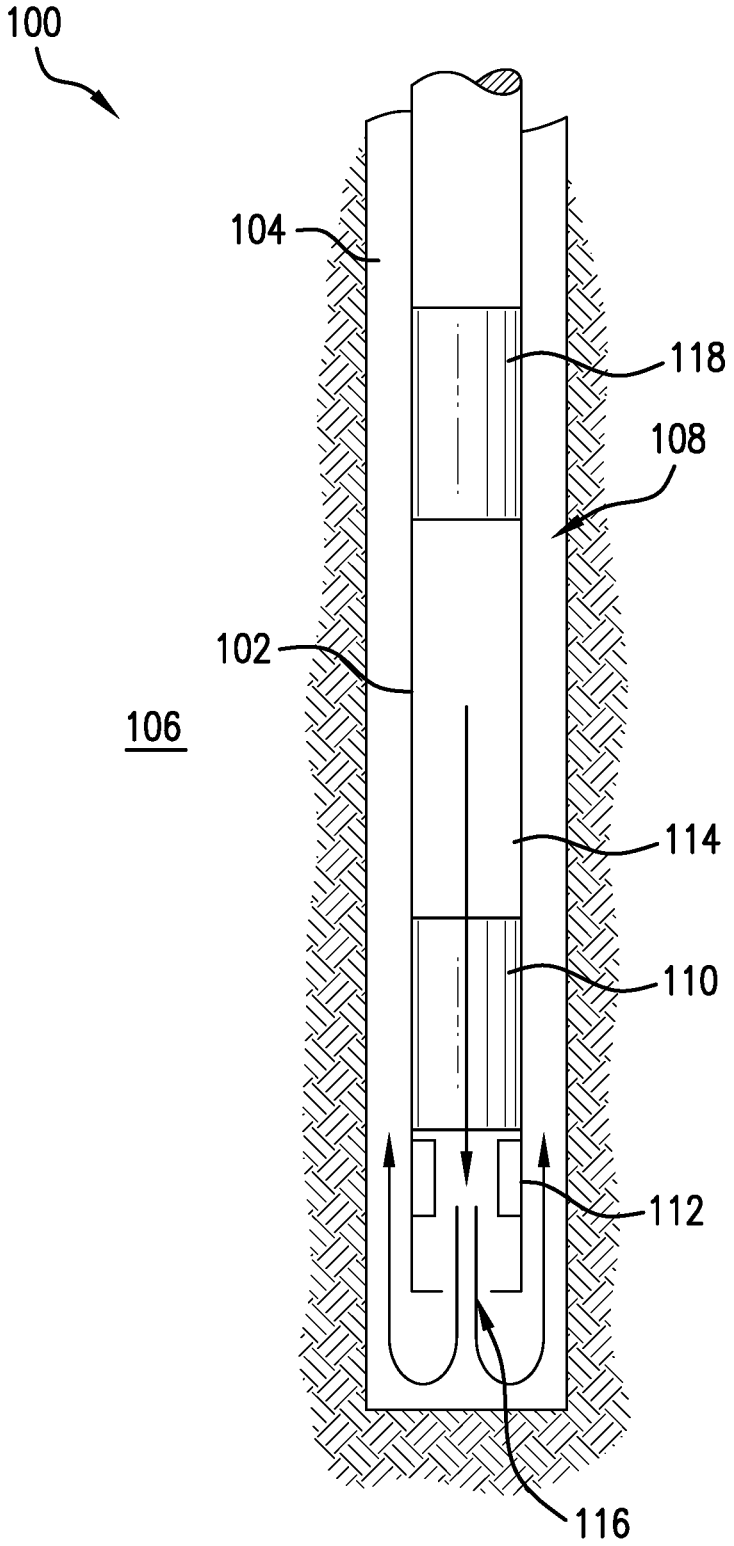
FIG. 1 shows a casing system is shown in an illustrative embodiment.

Referring to FIG. 1, a casing system 100 is shown in an illustrative embodiment. The casing system 100 includes a casing 102 disposed in a wellbore 104 in a formation 106. An annulus 108 is formed in the wellbore 104 between the casing 102 and the formation 106. Cement is introduced into the annulus 108 in order to create a barrier between casing 102 and formation 106. In order to introduce the cement, a first liner plug, referred to herein as a lead plug 110, is dropped or lowered into the casing 102 from the surface and settles on a protrusion 112 at a bottom or lower end of the casing 102, thereby plugging the casing 102. A cement slurry 114 is then pumped through the casing 102 to rupture a member in the lead plug 110 to create an opening in the lead plug 110, allowing the cement slurry to pass into the wellbore 104 via the opening and an opening 116 at a bottom end of the casing 102. The cement slurry 114 then flows uphole along the annulus 108. A second liner plug, referred to herein as a follow plug 118, is lowered onto the cement slurry 114 within the casing 102 and a downward force is applied to the follow plug 118 to push the cement slurry 114 into the annulus 108 and uphole. The follow plug 118 eventually settles on the lead plug 110 and the cement slurry 114 is allowed to set within the annulus 108. Once the cement has set, a drill string and milling device (such as a drill bit) are lowered into the casing 102 to drill out the follow plug 118 and the lead plug 110. During the drill out operation, the drill bit rotates and applies a torque to the follow plug 118 and lead plug 110.

Figure 2:
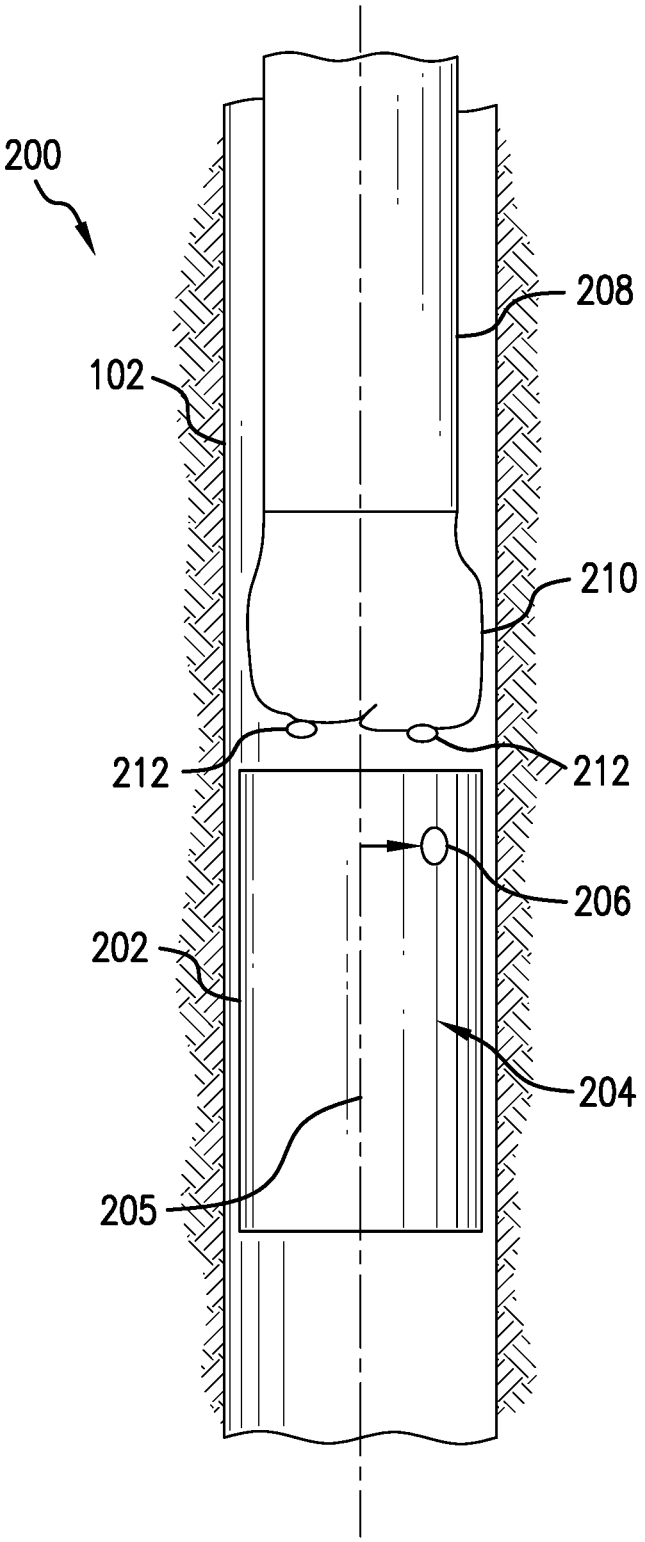
FIG. 2 illustrates a drilling out operation of a liner plug from a section of a casing.

FIG. 2 illustrates a drilling out operation of a liner plug 202 from a section 200 of a casing 102. The liner plug 202 can be the lead plug 110, the follow plug 118 of any other plug, in various embodiments. The liner plug 202 includes a body 204 extending along a longitudinal axis 205 and a body fragmentation feature 206 therein. In various embodiments, the body fragmentation feature 206 is radially offset from the longitudinal axis 205 at a selected radial distance. During the drill out operation, a drill string 208 is lowered within the casing 102, the drill string 208 including a milling device or drill bit 210 having cutters 212 at an end thereof. The drill string 208 is substantially aligned with the longitudinal axis 205 of the body 204 of the liner plug 202. During the drill out operation, the drill bit 210 is rotated, thereby causing cutters 212 radially offset from the longitudinal axis 205 to follow a circular path around the longitudinal axis 205. At least one cutter 212 of the drill bit 210 can be radially offset from the longitudinal axis 205 at a same radial distance as the body fragmentation feature 206. For a liner plug 202 that does not include the body fragmentation feature 206, or for a section of the body 204 that does not include a body fragmentation feature 206, the cutters 212 continuously come into contact with material of the body 204 during their rotation about the longitudinal axis 205, thereby drilling through the body 204 at a first rate. However, when the cutters 212 interact with or cut through the body fragmentation feature 206, the cutters 212 catch on the body fragmentation feature 206 and drill through the body 204 at a second rate greater than the first rate.

In one embodiment, the body fragmentation feature 206 is a void, cavity, hole or passage within the body 204. The void can be completely enclosed within the body 204 or can be in contact with an outer surface of the body 204. A center of the void can be offset radially from the longitudinal axis 205 of the body 204. As the cutter 212 contacts the void, the cutter catches on an edge or surface of the void. The cutter 212 cuts away a greater amount of the body 204 by catching on the edge than by cutting through a section in a section of the body 204 in which there is no void for the cutter to catch onto. Thus, by placing one or more voids within the body 204, the rate of penetration of the drill bit, or similarly, the rate of disintegration of the liner plug 202, is increased. The liner plug 202 can therefore be drilled out more quickly that a liner plug that lacks a void.

Figure 3:
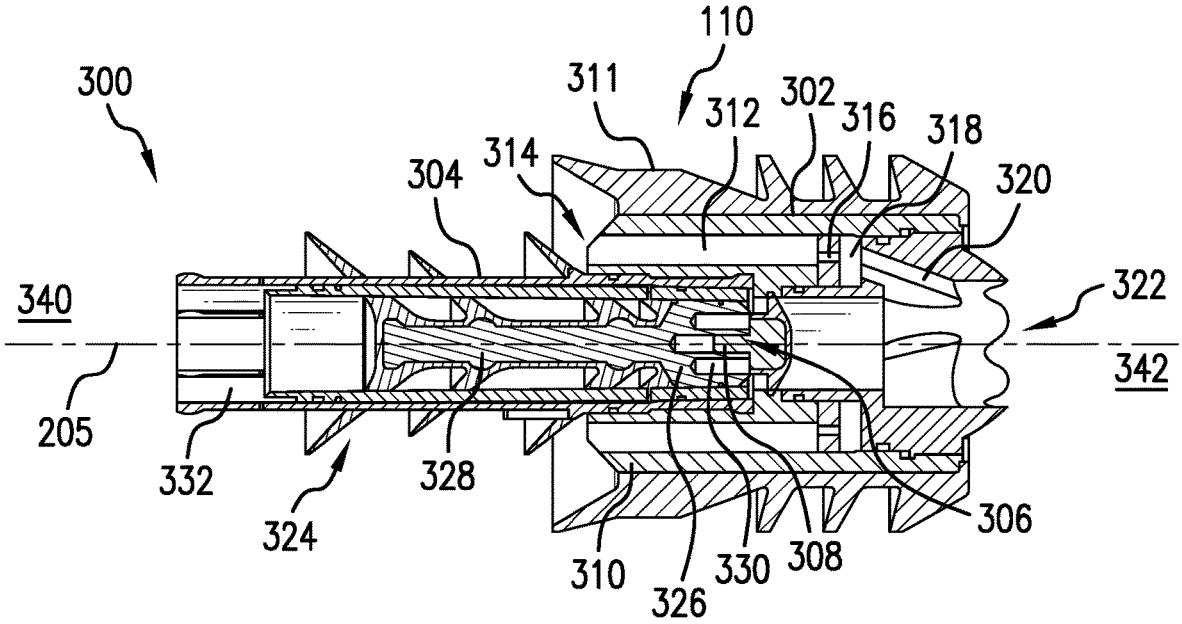
FIG. 3 shows a detailed cross-sectional view of a lead plug of the casing system.

FIG. 3 shows a detailed cross-sectional view 300 of the lead plug 110, in an embodiment. The lead plug 110 extends from an inlet end 340 to an outlet end 342 along a longitudinal axis 205. The lead plug 110 includes a body 302 extending along the longitudinal axis 205. The body 302 supports an elastomer sleeve 311 on its outer surface that engages the casing 102 to slide along the inner surface of the casing 102 and sweeps fluid and debris ahead of the lead plug 110 as the lead plug 110 passes through the casing 102. The body 302 includes a bore 306 formed at the inlet end 340 that is concentric with the longitudinal axis 205. The bore 306 extends to a location within the body 302. A tubular insert 304 couples to the lead plug 110 by being inserted into the bore 306. A prong 308 at a bottom of the bore 306 extends along the longitudinal axis 205 from the bottom toward the inlet end 340 to receive a pump down plug 324.

The body 302 includes a rim portion 310 formed about the bore 306. The rim portion 310 has a radial thickness extending from an inner radius at the bore 306 to an outer radius at an outer surface of the body 302. The rim portion 310 includes at least one passage through the rim serving as a body fragmentation feature 206. The passage forms a vertical hole 312 that extends parallel to the longitudinal axis 205 through the rim portion 310. The rim portion 310 can include a plurality of passages. The passages or vertical holes 312 can be evenly spaced circumferentially within the rim portion 310.

The vertical holes 312 extend from an inlet 314 past the bottom of the bore 306 into a chamber 316 having a membrane 318 therein. The membrane 318 blocks the chamber 316 and prevents a flow of fluid through the lead plug 110 as the lead plug 110 is being lowered through the casing. Once the lead plug 110 is settled in the casing, a fluid pressure (e.g., a pressure of the cement slurry) can be increased to rupture or shear the membrane 318. The chamber 316 is fluidly connected to one or more exit passages 320 that lead to an outlet 322 at the outlet end 342. During the cementation process, the cement slurry passes from the inlet end 340 to the outlet end 342 via the vertical holes 312, chamber 316 and exit passages 320.

The tubular insert 304 has an end that is distal from the lead plug 110, with the end including axial slots. A pump down plug 324 can be attached to the lead plug 110 at the tubular insert 304 to help move the lead plug 110 through the casing under fluid pressure. The pump down plug 324 includes a head 326 and a tail 328. The head 326 includes one or more cavities 330 extending axially along the pump down plug 324. When a selected pressure is applied (generally once the lead plug 110 has been anchored within the casing), the pump down plug 324 can pass into the tubular insert 304 and the bore 306 of the lead plug 110. The head 326 of the pump down plug 324 lands at a predetermined location in the lead plug 110 to seal the bore.

During the cementation process, cement slurry flows through the vertical holes 312 of the body 302 of the lead plug 110. When the lead plug 110 is being drilled out, the drill bit catches on the edges of the vertical holes 312, allowing the drill bit to disintegrate the lead plug 110 at an increased rate in comparison to a lead plug in which body does not include the vertical holes. In addition, the cavities 330 of the head 326 of the pump down plug 324 allow the pump down plug 324 to be drilled out more quickly that a pump down plug 324 without the cavities. While the inventions is discussed with respect to the lead plug of a liner plug system that includes both a lead plug and a follow plug, it is to be understood that the plug can be a single plug disposed in downhole.

Figure 4:
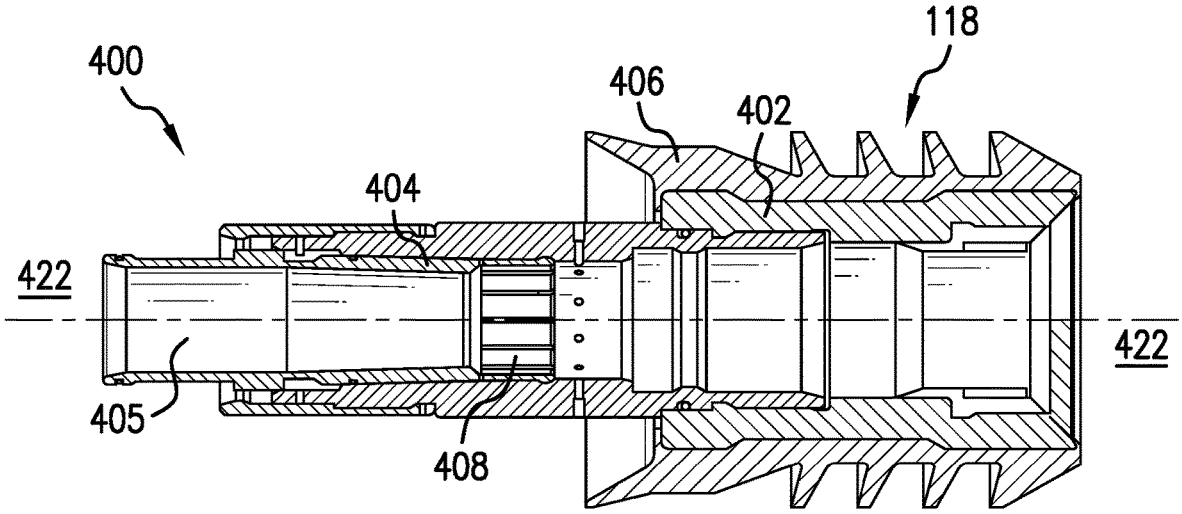
FIG. 4 shows a detailed cross-sectional view of a follow plug of the casing system.

FIG. 4 shows a detailed cross-sectional view 400 of the follow plug 118. The follow plug 118 extends from a first end 420 to a second end 422. The follow plug 118 includes a body 402 surrounding a tubular insert 404 and supporting an elastomeric seal 406. The tubular insert 404 extends away from the follow plug 118 in the direction of the first end 420 of and receives a displacement fluid which forces the follow plug through the casing. The tubular insert 404 includes slots or grooves 408 at a location near the follow plug 118. The drill bit catches on the slots or grooves 408 on the tubular insert 404, thereby disintegrating the tubular insert 404 at an increased rate in comparison to a non-slotted tubular insert. Although not shown in FIG. 4, a pump down plug can be attached to the tubular insert 404 and used to aid in pumping the follow plug 118 into the casing.

Figure 5:
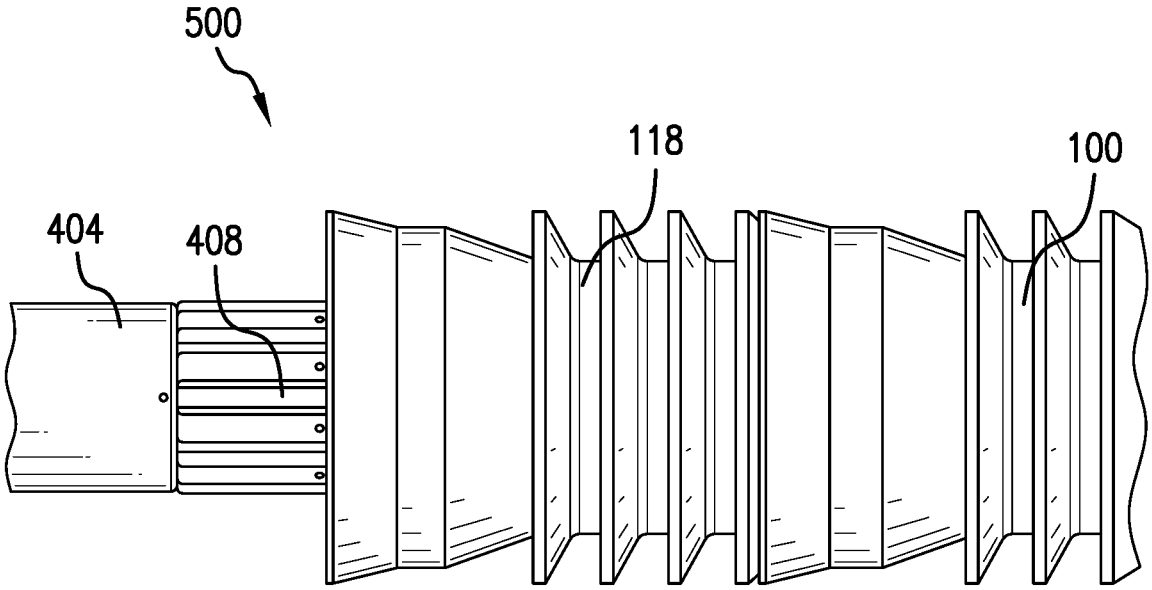
FIG. 5 shows a side view of a liner plug assembly including the lead plug and follow plug joined together.

FIG. 5 shows a side view of a liner plug assembly 500 including the lead plug 110 and follow plug 118 joined together. The second end 422 of the follow plug 118 is joined to the inlet end 340 of the lead plug 110. The tubular insert 404 extends from the first end 420 of the follow plug 118. Slots or grooves 408 are formed in the tubular insert 404 near the body of the follow plug 118, forming a tubular fragmentation feature.

Figure 6:
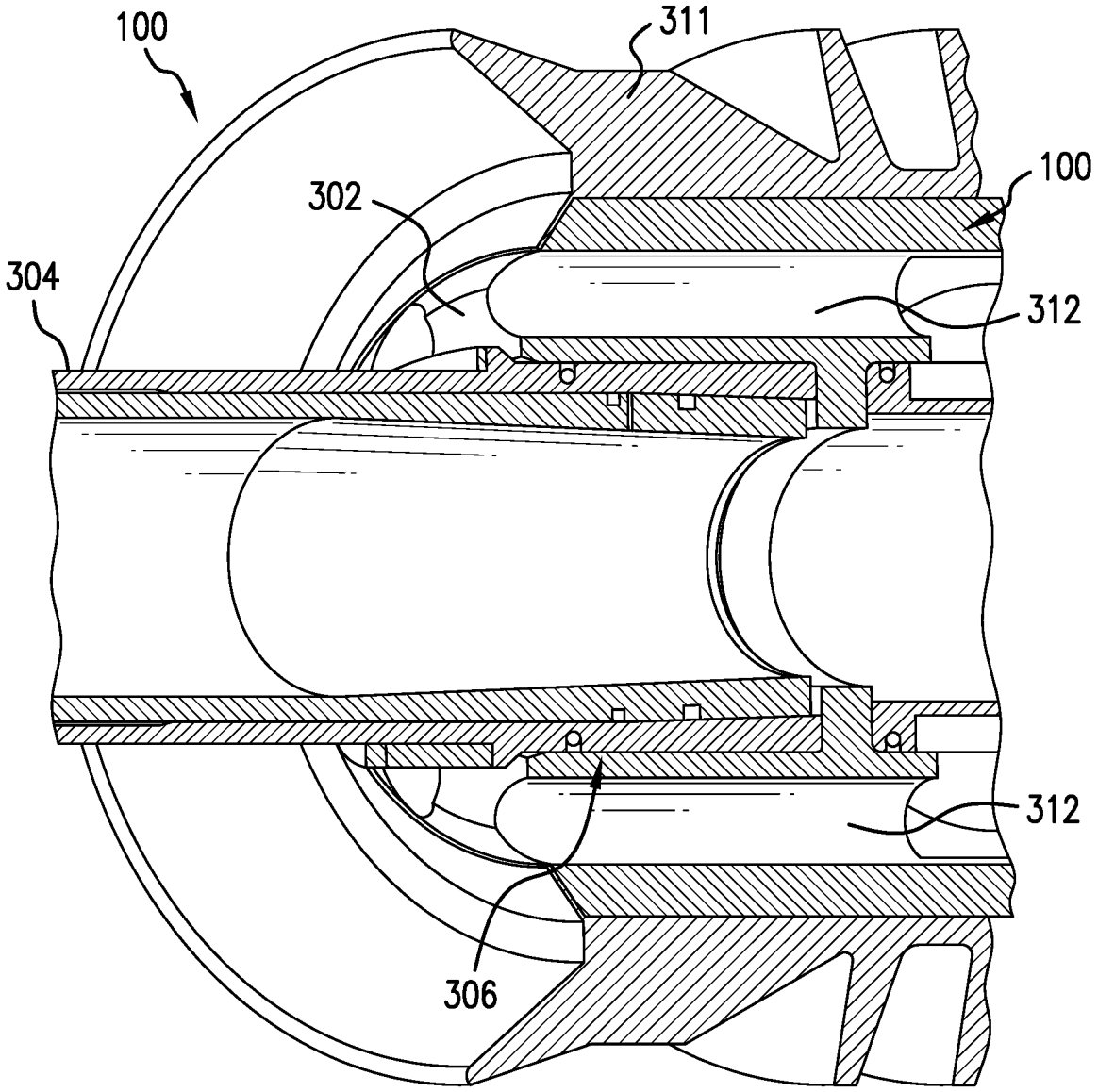
FIG. 6 shows a cut-away view of the lead plug in an exemplary embodiment.

FIG. 6 shows a cut-away view of the lead plug 110 in an exemplary embodiment. The body 302 is shown surrounding by elastomer sleeve 311. Bore 306 is formed in the body 302 and the tubular insert 304 is disposed within the bore 306. The vertical holes 312 are shown evenly spaced around the circumference of the bore 306 within the rim portion of the body.

Set forth below are some embodiments of the foregoing disclosure:

Embodiment 1. A liner plug for use in a casing. The liner plug includes a body for plugging the casing and a body fragmentation feature in the body for catching a cutter of a drill bit used to cut the body.

Embodiment 2. The liner plug of any prior embodiment, wherein the body extends along a longitudinal axis and the body fragmentation feature is at a radial distance from the longitudinal axis and the cutter is at the same radial distance from the longitudinal axis as the body fragmentation feature.

Embodiment 3. The liner plug of any prior embodiment, wherein the body fragmentation feature includes a void in the body, a center of the void being offset radially from the longitudinal axis of the body.

Embodiment 4. The liner plug of any prior embodiment, wherein the void includes a vertical hole extending parallel to the longitudinal axis.

Embodiment 5. The liner plug of any prior embodiment, wherein the vertical hole extends from an inlet end of the body to a location within the body.

Embodiment 6. The liner plug of any prior embodiment, wherein the vertical hole allows for flow of a fluid through the body.

Embodiment 7. The liner plug of any prior embodiment, further comprising a tubular coupled to the body, the tubular including a tubular fragmentation feature.

Embodiment 8. The liner plug of any prior embodiment, wherein the tubular fragmentation feature includes a slot on an outer surface of the tubular.

Embodiment 9. A liner plug assembly. The liner plug assembly includes a lead plug having a body for plugging the casing and a body fragmentation feature in the body for catching a cutter of a drill bit used to cut the body.

Embodiment 10. The liner plug assembly of any prior embodiment, wherein the body extends along a longitudinal axis and the body fragmentation feature is at a radial distance from the longitudinal axis and the cutter is at the same radial distance from the longitudinal axis as the body fragmentation feature.

Embodiment 11. The liner plug assembly of any prior embodiment, wherein the body fragmentation feature includes a void in the body, a center of the void being offset radially from the longitudinal axis of the body.

Embodiment 12. The liner plug assembly of any prior embodiment, wherein the void includes a vertical hole extending parallel to the longitudinal axis.

Embodiment 13. The liner plug assembly of any prior embodiment, wherein the vertical hole extends from an inlet end of the body to a location within the body to allow for flow of a fluid through the body.

Embodiment 14. The liner plug assembly of any prior embodiment, further comprising a tubular coupled to the body, the tubular insert including a tubular fragmentation feature including a slot on an outer surface of the tubular.

Embodiment 15. The liner plug assembly of any prior embodiment, further comprising a follow plug having a follow plug fragmentation feature.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A liner plug for use in a casing, comprising:

a body for plugging the casing, the body extending along a longitudinal axis;

a bore extending into the body at an inlet end, wherein the bore is concentric with the longitudinal axis and defines a rim portion of the body; and a void in the rim portion of the body for catching a cutter of a drill bit used to cut the body, wherein the void is offset radially from the longitudinal axis.

2. The liner plug of claim 1, wherein the void includes a vertical hole extending parallel to the longitudinal axis.

3. The liner plug of claim 2, further comprising a chamber within the body, wherein the vertical hole extends from the inlet end of the body to the chamber.

4. The liner plug of claim 3, wherein the vertical hole allows for flow of a fluid through the body.

5. The liner plug of claim 1, further comprising a tubular coupled to the body at the bore, the tubular including a head having a plurality of cavities extending along the longitudinal axis of the linear plug.

6. The liner plug of claim 5, further comprising a slot on an outer surface of the tubular.

7. A liner plug assembly, comprising:

a lead plug having a body for plugging a casing, the body extending along a longitudinal axis;

a bore extending into the body at an inlet end, wherein the bore is concentric with the longitudinal axis and defines a rim portion of the body; and a void in the rim portion of the body for catching a cutter of a drill bit used to cut the body, wherein the void is offset radially from the longitudinal axis.

8. The liner plug assembly of claim 7, wherein the void includes a vertical hole extending parallel to the longitudinal axis.

9. The liner plug assembly of claim 8, further comprising a chamber within the body, wherein the vertical hole extends from the inlet end of the body to the chamber to allow for flow of a fluid through the body.

10. The liner plug assembly of claim 7, further comprising a tubular coupled to the body at the bore, the tubular insert including a head having a plurality of cavities extending along the longitudinal axis of the linear plug.

11. The liner plug assembly of claim 7, further comprising a follow plug.

12. The liner plug assembly of claim 10, further comprising a slot on an outer surface of the tubular.

* * * * *